US005618089A

United States Patent [19]

Stenemann

[11] Patent Number: 5,618,089

[45] Date of Patent: Apr. 8, 1997

[54] DEVICE FOR THE SWIVELING MOVEMENT OF A SHEET, IN PARTICULAR IN REFRIGERATION COUNTERS OR MERCHANDISE COUNTERS

[75] Inventor: Bruno Stenemann, Beckum, Germany

[73] Assignee: Gerd und Bernd Vieler KG, Germany

[21] Appl. No.: 377,441

[22] Filed: Jan. 24, 1995

[30] Foreign Application Priority Data

Jan. 29, 1994 [DE] Germany ..... 44 02 727.3

[51] Int. Cl.[6] ..... A47F 3/04; F25D 11/00

[52] U.S. Cl. ..... 312/116; 312/114; 312/140.1; 312/140.4; 312/401; 312/405

[58] Field of Search ..... 312/114, 116, 312/140.1, 140.4, 401, 405; 16/66; 49/386

[56] References Cited

U.S. PATENT DOCUMENTS

| | | | |
|---|---|---|---|
| 4,842,349 | 6/1989 | Stinemann | 312/116 |
| 4,854,554 | 8/1989 | Ludwig | 16/66 X |
| 5,112,118 | 5/1992 | Wiehle | 312/116 |
| 5,116,274 | 5/1992 | Artwohl | 312/116 |
| 5,207,490 | 5/1993 | Kasper et al. | 312/405 X |

FOREIGN PATENT DOCUMENTS

| | | | |
|---|---|---|---|
| 502574 | 9/1992 | European Pat. Off. | 312/116 |
| 2605352 | 8/1977 | Germany | 312/116 |
| 3503340 | 8/1986 | Germany | 312/116 |
| 3828089 | 3/1989 | Germany | 312/116 |
| 8502823 | 5/1987 | Netherlands | 312/140.1 |

*Primary Examiner*—Peter M. Cuomo
*Assistant Examiner*—Rodney B. White
*Attorney, Agent, or Firm*—McAulay Fishner Nissen Goldberg & Kiel, LLP

[57] ABSTRACT

A device for the swiveling movement of a sheet is described. A stationary bearing part supports an articulated part in a swivelable manner. The articulated part supports the sheet and is movable about a substantially horizontal swivel axis. The sheet is accordingly movable between a lowered position and a raised position, the direction of this movement being determined by a vertical swiveling plane. Energy accumulators, e.g., pneumatic springs, serve as auxiliary lifting means for raising the sheet. These energy accumulators have two connection ends which are loaded in opposite directions and determine the effective direction of force of the energy accumulator. For the purpose of an advantageous arrangement of the device which economizes on space, it is proposed that the energy accumulator be arranged with its effective direction of force substantially transverse to the swiveling plane of the sheet. The two connection ends of the energy accumulator are constructed as three-dimensionally acting rolling joints.

21 Claims, 8 Drawing Sheets

IV
50
53
60
34
32
30
33
31
29
24
21
25
20
22
43
41
40
42
44
51
54
61
62
70
69
23
40'
20'

DEVICE FOR THE SWIVELING MOVEMENT OF A SHEET, IN PARTICULAR IN REFRIGERATION COUNTERS OR MERCHANDISE COUNTERS

BACKGROUND OF THE INVENTION a) Field of the Invention

The invention is directed to a device for the swiveling movement of a sheet. Such devices are used in counters for selling merchandise and can also be designed as refrigeration counters. The merchandise is displayed to the customer in the interior of the counter. A sheet associated with the device serves to protect the merchandise in the counter and is preferably transparent so that the customer may view the merchandise. The sheet is swivelable about a horizontal axis and is located in a lowered position to protect the merchandise inside the counter. However, the sheet can be swiveled up into a raised position in order to fill the counter with merchandise or clean the interior of the counter.

b) Description of the Related Art

For this purpose, the sheet is attached to an articulated part which is supported in a bearing part so as to be swivelable. An energy-storing device or energy accumulator, generally constructed as a pneumatic spring, serves as auxiliary lifting means to facilitate the lifting of the sheet. This energy accumulator has two connection ends, one of which is articulated at the movable articulated part while the other connection end is articulated so as to be stationary. The two connection ends are loaded by force such that their relative distance from one another increases. This force loading facilitates the lifting of the sheet, secures the sheet in its folded up position and cushions the lowering of the sheet. The sheet is swiveled between its lowered and raised positions substantially in a vertical plane which will accordingly be referred to hereinafter as "swiveling plane" for the sake of brevity. The effective direction of force of the energy accumulator is determined by the load exerted on its two connection ends.

In known devices of this type, the effective direction of force of the energy accumulator was always disposed parallel to the swiveling plane of the sheet. In counters having a horizontal plate, a so-called money transaction surface or "sales countertop" (EP-0 263 957-A2), horizontal supporting arms are required to secure it. The supporting arms have a U-section, each leg of the U forming a bearing part for the swivelable articulated part holding the sheet. The energy accumulators are arranged inside the U-section and their connection ends are supported on one side at the articulated part via hinges and on the other side at a stationary articulation point in the supporting arm. Consequently, not only the entire length of the energy accumulator, but also at least a portion of the articulated part is arranged in the supporting arms. The supporting arms must therefore have a determined minimum length, which reduces the available space in the counter. Moreover, the position of the energy accumulator is linked to the position of its supporting arm in the counter, which restricts freedom in constructing a counter.

For counters having a curved sheet rather than a stationary sales countertop (DE-90 04 215-U), the device must be modified. More particularly, the energy accumulators are arranged inside hollow supports which project diagonally upward with their lower end arranged in a stationary manner at the counter body. The bearing part for the articulated part supporting the sheet is located at the free upper end of the support. Apart from the special construction of the device required for this counter, it is disadvantageous that the arrangement of the energy accumulator and articulated part is always dependent on the support. Further, the installation of the device in the interior of the support is complicated. Finally, a large dimensioning of the support is required for installing these parts.

OBJECT AND SUMMARY OF THE INVENTION

The primary object of the present invention is to develop a device of the type mentioned above which makes economical use of space, can be used for multiple purposes and is easy to assemble and maintain. This object is met according to the invention, particular details of which will be discussed in the following.

The invention is based on a novel principle of construction. The effective direction of force of the energy accumulators no longer lies parallel to the swiveling plane of the sheet, but rather intersects this swiveling plane. Accordingly, in contrast to the prior art, the energy accumulator can extend longitudinally more or less transversely to the swiveling plane so that the dimensioning of the device transversely to the swiveling plane can be minimized. Accordingly, the effective direction of force of the accumulator can be arranged approximately parallel to the swivel axis as seen in the lowered position of the sheet. In the swiveling plane of the sheet, that is, vertical to its swivel axis, the device according to the invention only has an overall width determined by the dimensions of the articulated part, since the overall width of the energy accumulator itself is usually considerably smaller than the articulated part. In the prior art, by contrast, the overall length of the energy accumulator adds to the dimensions of the articulated part in the swiveling plane. But the overall length of the device according to the invention, which lies substantially in the direction of the swivel axis, does not present a problem because there is always sufficient room in the direction of the swivel axis for installing the device in a body. If the device is installed in a counter, for example, the sales countertop mentioned above extends in the direction of the swivel axis. Therefore, installation of the device requires only a narrow region which, for this reason, need not be taken into account in designing the width of the sales countertop so that this width may be very narrow, for example. Further, the gained space can be utilized in the adjacent countertop region to arrange additional elements such as light-directing shades in which light sources are mounted for illuminating the interior of the counter.

In the case of hinged windows in rail-borne vehicles and busses (DE 19 88 255) it is known to arrange a longitudinally resilient spring leg between the free edge of the window and a bearing block. The bearing block projects out in the direction of the folded out open position of the window relative to a plane (opening plane) delimiting the window opening. The purpose of the spring leg is to stabilize both the open position and closing position of the window relative to the opening plane. Proceeding from the stationary bearing block, the spring leg extends diagonally toward the opening plane in the open position of the window and diagonally away from the opening plane in the closed position of the window. The longitudinal resilience of the spring leg is relaxed in both positions so that an additional expenditure of force is required to open and close the window. Auxiliary lifting means for vertical swiveling of a sheet are not disclosed in this reference.

Further steps and advantages of the invention are contained in the subclaims, the following description and drawings. The drawings show the invention with reference to a number of embodiment example.

DESCRIPTION OF THE PREFERRED EMBODIMENTS

Figure 1:
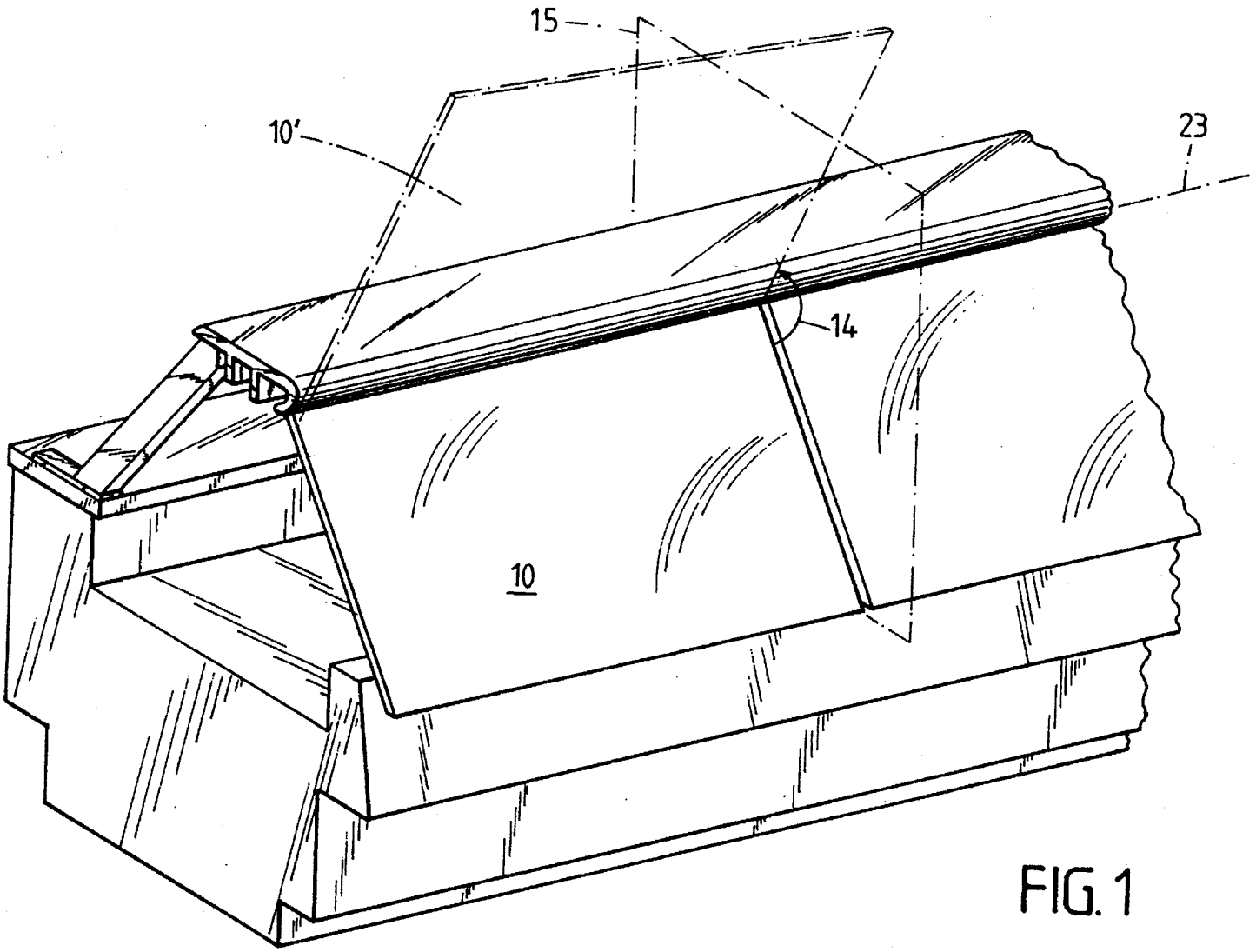
FIG. 1 shows a perspective view of a merchandise counter in which the device according to the invention is installed.
Figures 2, 3:
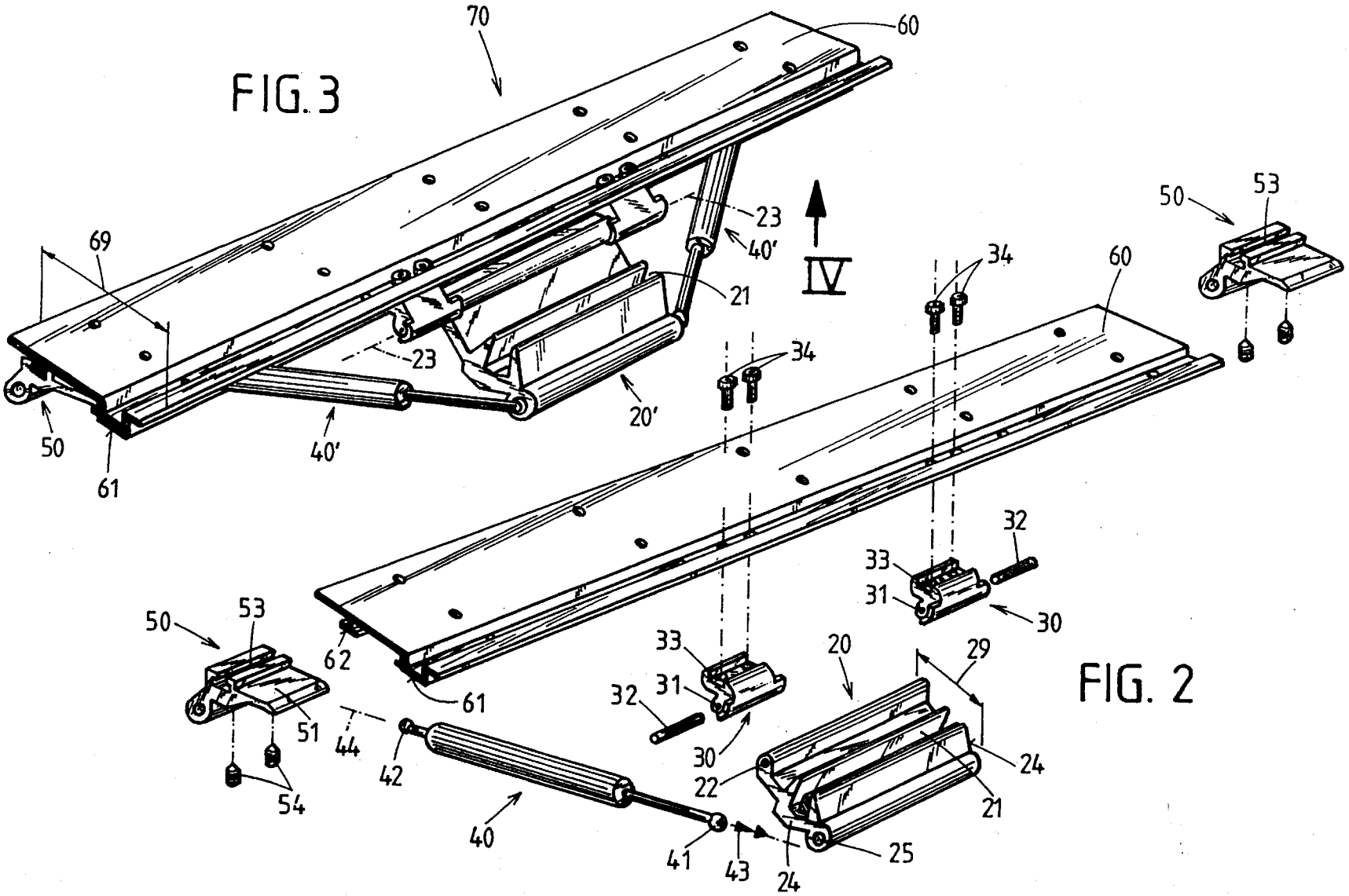
FIGS. 2 and 3 show a perspective view of a first construction of the device according to the invention in an exploded diagram of its structural component parts and in the assembled state of these structural component parts, respectively, in which the movable structural component parts are shown in the raised position of the sheet which is omitted from the drawing.
Figure 9:
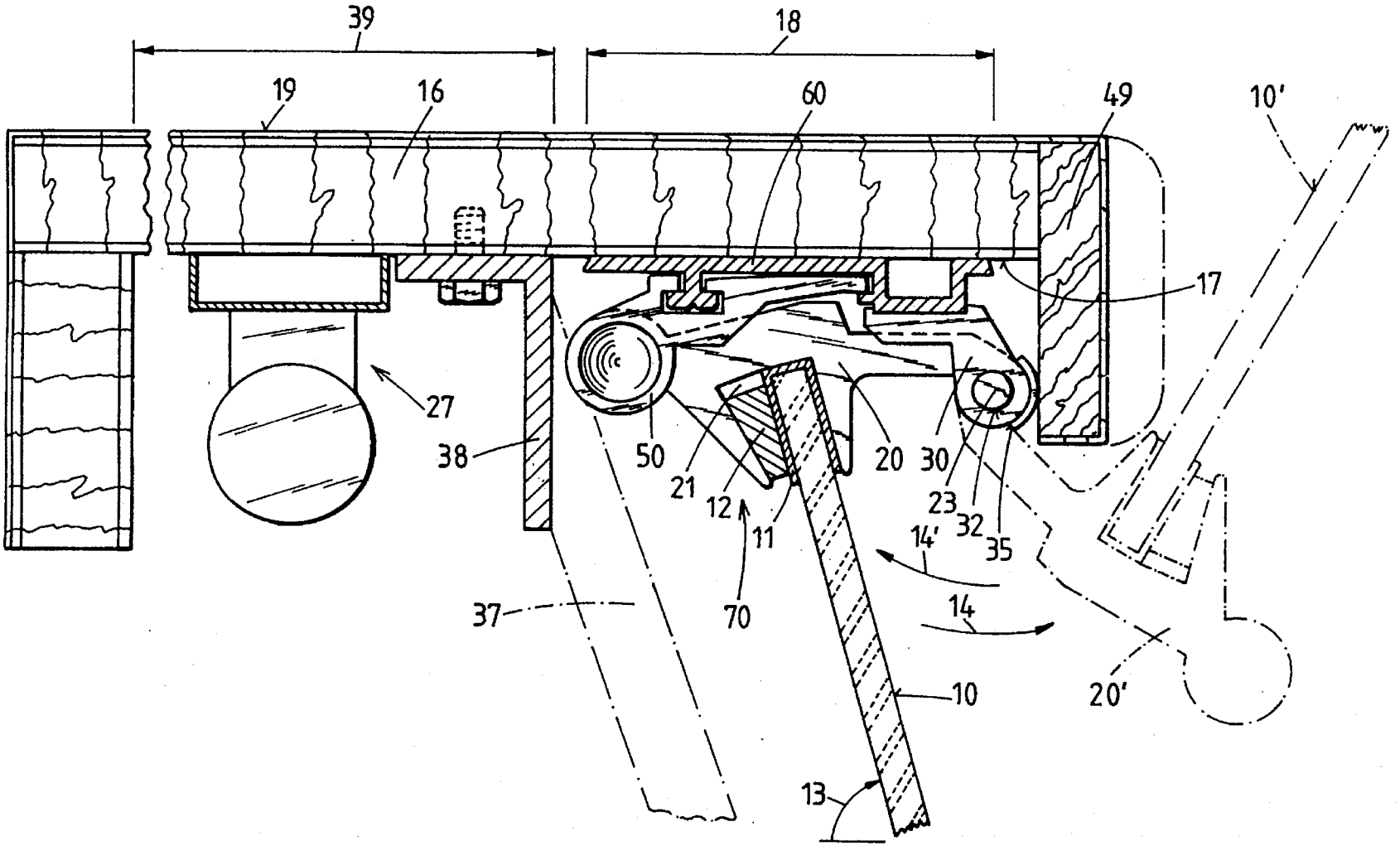
FIG. 9 shows a first possible application of the device of FIG. 3 in a merchandise counter with a horizontal support or carrier as seen in cross section through the carrier and partially cut away, the lowered position of the sheet is indicated in solid lines and the raised position in dash-dot lines.

The device is used for moving a sheet 10 between its lowered position, shown in solid lines in FIGS. 1 and 9, and its raised position 10' indicated in dash-dot lines in FIG. 9 The basic structural component parts belonging to this device are shown in FIGS. 2 and 3 and include an articulated part 20. The articulated part 20 has a holding groove 21 which tapers in a wedge-shaped manner toward the groove opening and, as shown in FIG. 9, receives a holding strip 12 with a wedge-shaped cross section in addition to the upper edge 11 of the sheet. Depending on the given construction, the angle of inclination 13 of the sheet 10 in the lowered position can be effected simply by exchanging the order in which the sheet edge 11 and holding strip 12 are arranged in the holding groove 21 of the articulated part 20. An additional variation of the angle of inclination 13 can be produced by using more than one holding strip 12 and, in so doing, rearranging the sequence of the holding strips and sheet edge 11.

Figure 4:
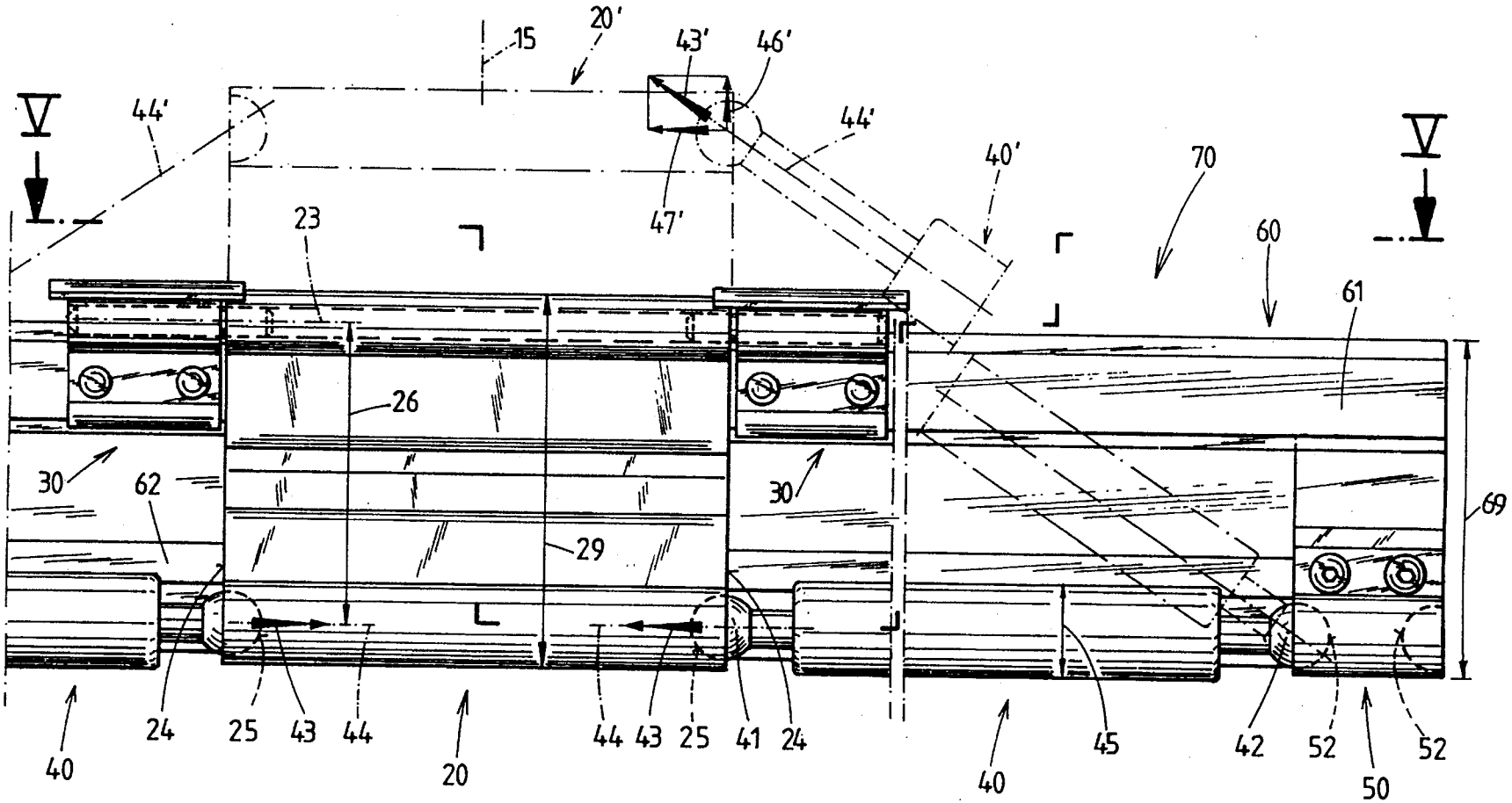
FIG. 4 shows a cut-away view of the device as seen from the bottom in the direction of arrow IV in FIG. 3 and in enlarged scale compared to FIG. 3; the raised position of the sheet shown in FIG. 3 is indicated here in dash-dot lines and the lowered position of the sheet, as shown in FIG. 8, is indicated in solid lines, the sheet being omitted in FIG. 4 and FIG. 3.

As will be seen from FIGS. 2 and 9, two bearing parts 30 having bore holes 31 for two bearing pins 32 are associated with the articulated part 20. The articulated part 20 also has a continuous bore hole 22 which receives an end piece of the two pins 32, respectively, and therefore, together with the bearing parts 30, determines the swivel axis 23 indicated by a dash-dot line in FIG. 3. The articulated part is formed by a profiled part with rectangular profile, the two bearing parts 30 with the two aligned bearing pins 32 contacting opposite sides 24 of this profiled part. Further, at least one energy accumulator 40 acts at a lateral offset 26 to the swivel axis 23, as shown in FIG. 4, namely at the locations on the sides 24 of the articulated part 20 designated by 25.

The energy accumulator 40 serves as auxiliary lifting means for lifting the sheet 10 in the swiveling direction indicated by arrow 14 in FIG. 9 and is constructed in the present example as a so-called pneumatic spring. The arrow 14 indicating the swiveling of the sheet between its lowered position 10 and its raised position 10' determines a swiveling plane 15 which lies in the drawing plane in FIG. 9 and is indicated in dash-dot lines in the perspective views in FIGS. 1 and 5. This swiveling plane 15 extends vertically, i.e., at right angles to the horizontal swiveling plane 23 which is shown in FIG. 1 and in FIG. 5. The energy accumulator 40 also serves to cushion the movement of the sheet when the latter is swiveled back into its lowered position 10 from its raised position 10' in the swiveling direction indicated by arrow 14' also shown in FIG. 9.

The energy accumulator 40 has two connection ends 41, 42 which are loaded relative to one another. According to the line of action indicated by arrow 43 in FIG. 2, one connection end 41 endeavors to move away from the other connection end 42. This outward movement 43 of the connection ends 41, 42 is defined by internal stops in the energy accumulator 40. Arrow 43 accordingly determines the effective direction of force 44 of the pneumatic spring 40, indicated in dash-dot lines in FIG. 2, and thus its longitudinal extension. As can be seen from FIG. 4, the overall width 45 of the energy accumulator 40 is small and only occupies a limited space parallel to the swiveling plane 15.

Figure 5:
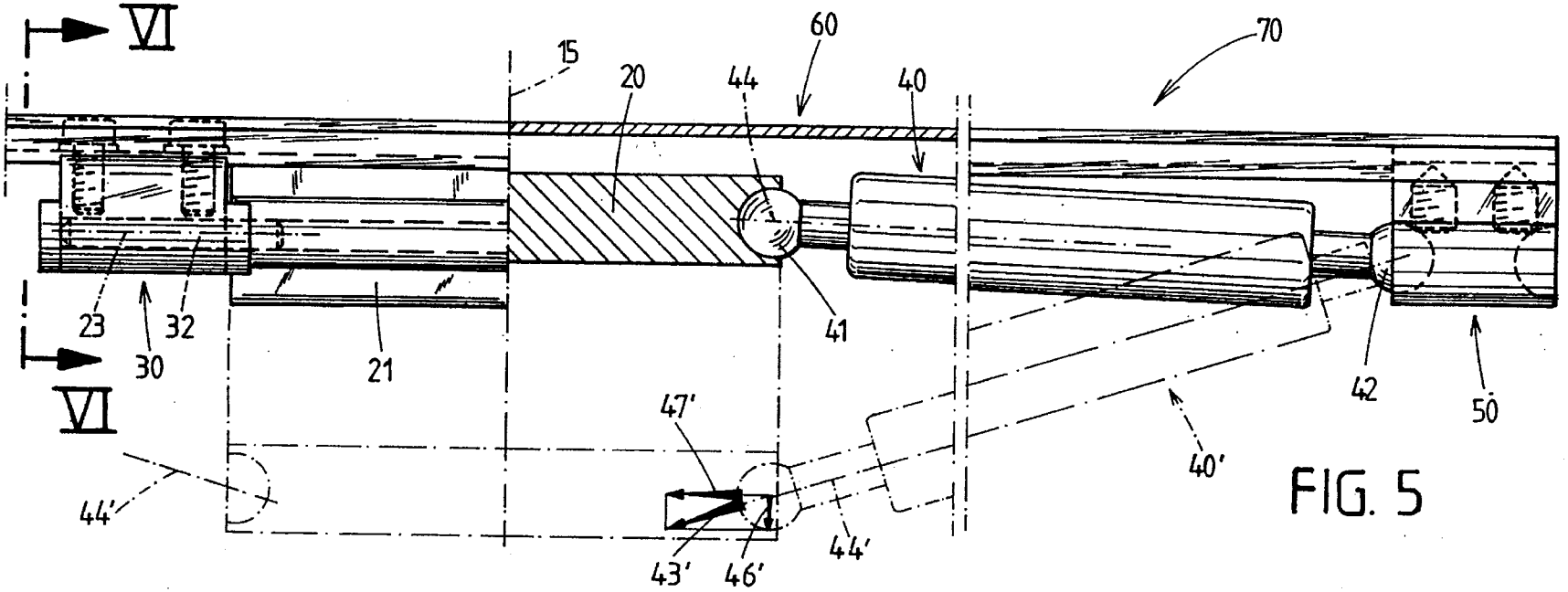
FIG. 5 shows a front view of the device from FIG. 4 in partial longitudinal section along the dispersed section line V—V of FIG. 4, partially cut away.

As can be seen most clearly from FIG. 5, the effective direction of force 44 of the energy accumulator 40 extends transversely to the swiveling plane 15. In the lowered position of the sheet shown in solid lines, the energy accumulator 40 extends substantially parallel to the swivel axis 23. As can be seen from the position 40' of the energy accumulator shown in dash-dot lines in FIGS. 4 and 5, the effective direction of force, indicated by 44' extends diagonally to the swivel axis 23 in the raised position 10' shown in FIG. 9. The two positions 40 and 40' of the energy accumulator are shown in FIGS. 4 and 5. When swiveled upward and downward 14, 14', respectively, as shown in FIG. 9, the effective direction of force 44, 44' describes part of an envelope of a cone whose tip is determined by the stationary position of one connection end 42 of the energy accumulator 40 mentioned above. In this stationary position, there is a support part 50 which is positioned in a stationary manner in the device according to the invention. Since two energy accumulators in a mirror-inverted arrangement at a common articulated part 20 are used in the present case, two of these support parts 50 are required. These support parts 50 are shown in FIG. 3 in their inclined position 40', mentioned above.

The structural component parts 20, 30, 40 and 50 mentioned above are mounted on a mounting base 60, shown most clearly in FIGS. 2 and 3, which, with the exception of the integrally formed guides 61, 62, has a substantially flat construction in the present case. The guides 61, 62 are formed integrally with a section bar as longitudinal extending rails. The mounting base is then cut out of this section bar in the desired length. Thus, the mounting base 60 is produced from a portion of such a section bar. According to FIG. 2, one guide 61 is used for mounting the two bearing parts 30 which, to this end, have a channel 33 complementing the rail profile of the guide 61. This permits a sliding adjustment of the bearing parts in the longitudinal direction of the rails. When assembled, the articulated part 20 is received between the two bearing parts 30 which are fixed in a defined position at the mounting base 60 by screws 34 shown in FIG. 2.

In a corresponding manner, the two support parts 50 also have channels 53 which are constructed to conform to the rail profile of the associated second guide 62 of the mounting base 60 as is shown in FIG. 2. The defined longitudinal position of the support parts 50 on their guide 62 is secured by clamping screws 54 which penetrate corresponding threaded bore holes in the support part 50 so as to act upon the guide 62. The two energy accumulators 40 extend between the two support parts 50 on one side and the common articulated part 20 on the other side. For this purpose, the support part 50 has a point of application 52—shown most clearly in FIG. 4—for the stationary outer connection end 42 of the respective energy accumulator 50. The support part 50 has one such point of application 52 on either side so that the same type of support part 50 may be used, if desired, for both energy accumulators 40 arranged in mirror-inverted fashion.

Figure 6:
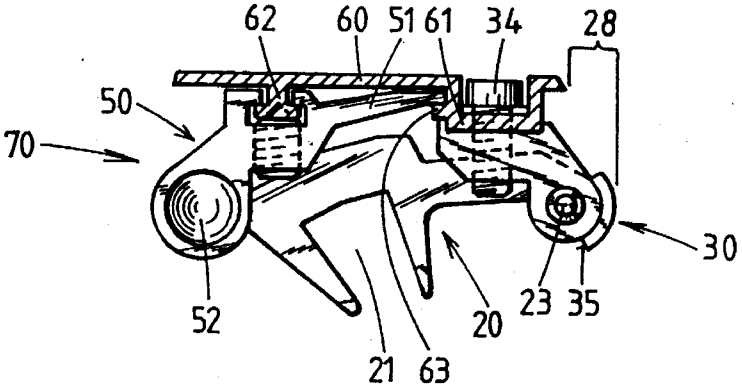
FIG. 6 show a cross-sectional view of the device along section line VI—VI shown in FIG. 5.

In the lowered position 10 of the sheet according to FIG. 9, the articulated part is situated in its swiveled in position 20 below the mounting base 60 as shown by solid lines in FIGS. 4 to 6. When a swiveling movement is carried out in the lifting direction 14 shown in FIG. 9, the articulated part arrives in the swiveled out position 20' in front of the mounting base 60 as shown in FIG. 9 and in FIGS. 4 and 5. During this lifting movement, as was already mentioned, the two energy accumulators 40 also execute a three-dimensional movement until they occupy the inclined position 40' indicated in dash-dot lines in FIGS. 4 and 5. For this reason, the connection ends 41, 42 and their points of application 25, 52 are designed as three-dimensionally acting rolling joints, more particularly, in the present case, as ball joints. As can be seen most clearly from FIG. 4, each of the two connection ends 41, 42 of the energy accumulator 40 is designed as a spherical head, while the lateral faces 42 of the articulated part 20 and the lateral surfaces of the two support parts 50 are constructed as spherical sockets 25, 52. In the swiveled in position 20 of the articulated part, in which the effective direction of force 44 of the two energy accumulators 40 extends substantially parallel to the swivel axis 23, the forces cancel one another when the two energy accumulators are loaded by forces of substantially identical magnitude. The energy accumulators 40 are pressed together to their maximum extent.

When the sheet is raised, a force component 46' is generated which acts in the direction of the swiveling plane and increases as the slope of the effective direction of force 44, 44' increases, which is illustrated most clearly in FIG. 4 by force component 46' with reference to the swiveled out position 20' of the articulated part. This force component 46' acts counter to the turning moment exerted on the articulated part 20, 20' by the weight of the sheet and increasingly reinforces the lifting of the sheet in the lifting direction 14 shown by the arrow in FIG. 9 or alleviates the weight of the sheet in the lowering direction 14' shown in FIG. 9. As indicated by the swiveled out position 20' of the articulated part shown in dash-dot lines, the resultant force 43' splits off into a component 47' running parallel to the swivel axis 23 as can be seen from the fully inclined position 40' of the energy accumulator. In the present case, however, this force component 47' is compensated for by the corresponding, oppositely directed force component of the other energy accumulator arranged in a mirror-inverted manner relative thereto. The position of this other energy accumulator is indicated in FIG. 4 only by its effective direction of force 44'. These two force components 47' parallel to the swivel axis do not load the two bearing parts 30 so that the latter may be designed in a simple manner. When an energy accumulator 40 is allowed to act only on one side, the opposite bearing part 30 should be constructed as a pressure bearing so as to take up these parallel force components 47'.

Together with the mounting base 60, the articulated part 20 and its two bearing parts 30 and the two support parts 50 used for mounting the energy accumulators 40 form a finished constructional unit 70 which can be preassembled. The constructional unit 70 can be fastened to a carrier or the like from which the swivelable sheet 10 can swivel out. The articulated part 20 located in this constructional unit 70 is used as a holder for attaching the sheet 10, but, with one or two energy accumulators 40, already contains energy sources which facilitate the lifting 14 or lowering 14' of the sheet 10. Thus, the constructional unit 70 is not only a means for holding the sheet, but is also an "energy package" which advantageously influences the swiveling movement 14, 14'. The swiveled out position 20' of the articulated part can be limited by swivel stops 35 at the bearing parts 30 as can be seen from the raised position 10' of the sheet indicated in dash-dot lines in FIG. 9. As can be seen from FIG. 6, the support part 50 also has a bracket arm 51 whose free end engages behind a profile strip 63 which is located on the mounting base 60 and serves for mounting the two bearing parts 30.

Figure 7:
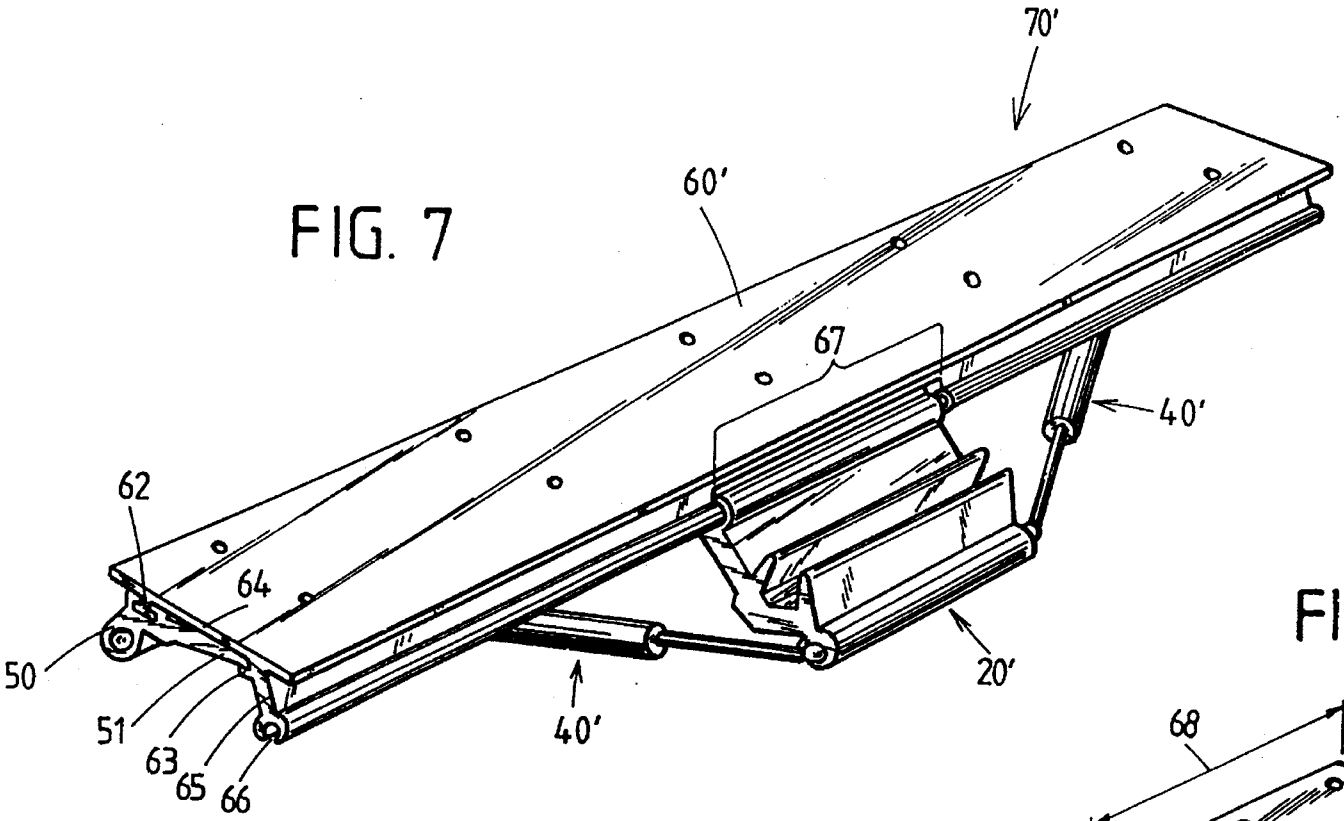
FIG. 7 shows an alternative construction of the device in a perspective view corresponding to FIG. 3.

FIG. 7 shows a constructional unit 70' having a modified construction compared with the preceding embodiment example. Identical structural component parts are provided with the same reference numbers used in the preceding embodiment example. It will be sufficient to limit the discussion to the differences between the embodiment examples, wherein reference is made to the preceding description in other particulars.

The constructional unit 70' shown in FIG. 7 has a different mounting base 60' which is not plate-shaped, but rather has an angular profile with two legs 64, 65. One leg 64 serves for fastening the constructional unit 70' on a carrier and for mounting the support parts 50. The longitudinal rail mentioned above is located on this constructional unit 70' for this reason. This fastening leg 64 is plate-shaped and the other leg 65 projects away from it at an angle. According to FIG. 7, the mounted support parts 50 also have the aforementioned bracket arms 51 which engage behind a profile strip 63. Accordingly, the turning moments exerted on the support parts 50 by the energy accumulators 40 are also absorbed in this case in an improved manner. The profile strip 63 is a component part of the bearing leg 65 of the angular profile. The other leg 65 has, at its free end, a continuous longitudinally extending bore hole 66 which is slit longitudinally for technical reasons relating to manufacture, but carries out the same function as the bore holes 31 of bearings parts 30 of the constructional unit 70 described above. This mounting base 60' is also produced from a portion of a section bar with an angular profile. A recess 67 is cut out of this leg 65 at the location of the articulated part which is shown in its swiveled out position 20' in FIG. 7. The articulated part 20 is rotatably supported via bearing pins 32 which are shown most clearly in FIG. 8.

Figure 8:
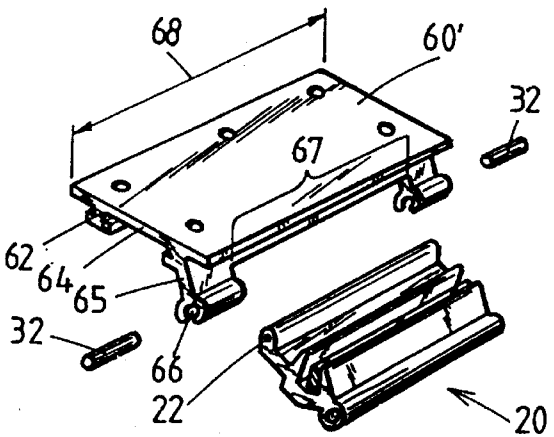
FIG. 8 shows a simplified construction of the device of FIG. 7 which can be used to supplement the device of FIG. 7 when using long sheets.

A section bar with the same angular profile as in FIG. 7 is used to produce the mounting base 60' of FIG. 8, but is cut to an appropriately shorter length 68. This is because the energy accumulators provided at both sides of the articulated part 20, which are shown in their inclined position 40' in FIG. 7, are omitted in the example shown in FIG. 8. The shorter mounting base 60' shown in FIG. 8 is used for an additional articulation point when using especially long sheets. The longitudinal rail 61 for mounting the support parts 50 has no function in the embodiment shown in FIG. 8 in contrast to FIG. 7.

As indicated in FIGS. 3 and 4, the overall width of the finished constructional unit 70 is determined by the mounting base 60 which has a small width 69. This overall width 69 depends substantially on the lateral length 29 of the articulated part 20. In its swiveled in position, the bearing part 20 which is swivelably supported on bearing part 30 can project out from this lateral length 29 only by a small edge piece 28 shown in FIG. 6. However, it is crucial that the overall width 69 of this constructional unit 70 is no longer determined by the length of the energy accumulator 40, since only the minimal width 45 of the energy accumulator extends in this direction in the parallel position according to FIG. 4. Thus, in the swiveling plane 15, the constructional unit 70 has only a small overall width 69 which depends only on the lateral length 29 of the articulated part. This is very advantageous with respect to the space requirement of the constructional unit 70 in the present example of use.

FIG. 9 shows a first application of this constructional unit 70 on a carrier 16 of a counter, not shown in more detail. This carrier 16 is made from wood material or the like and functions at the same time as a "sales countertop" of the counter. The constructional unit 70 is attached to the underside 17 of this carrier 16 and takes up only a small region 18 due to its small overall width 69 as mentioned above. In the adjacent region 39, the underside 17 of the carrier can be used for fastening additional construction elements, e.g., light sources 27, which in the present case are fluorescent tubes. An angled cross-piece 38 is arranged between these regions and can also be acted upon by a front support 37 of the counter indicated in dash-dot lines. The cross-piece 38 serves at the same time as a light shade. A front strip 49 can serve to cover the attached constructional unit 70. The upper side 19 of the carrier 16 remains free to serve as a "sales countertop".

Figure 10:
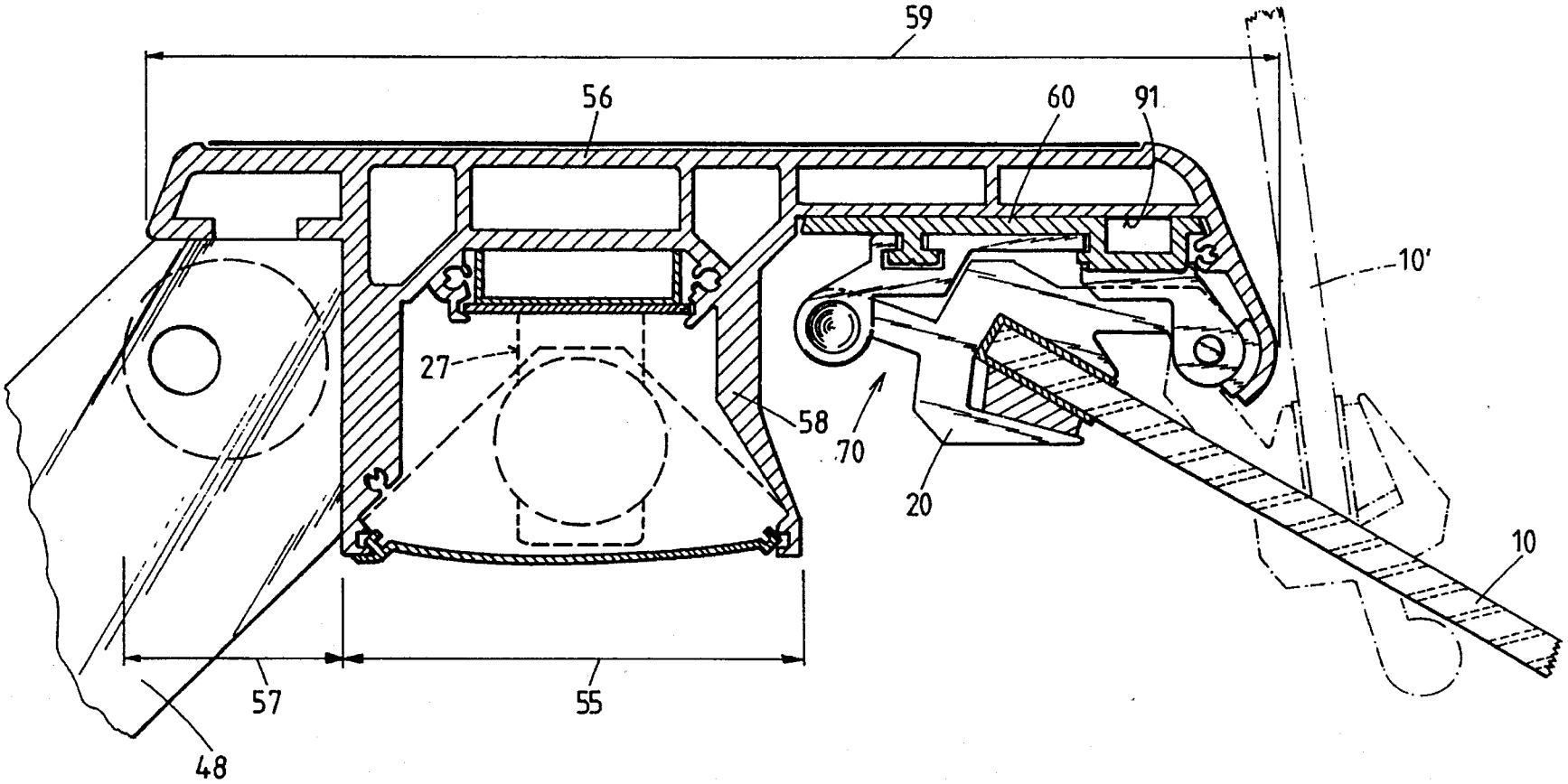
FIGS. 10, 11 and 12, respectively, show modified devices in cross section corresponding to FIG. 9 in three different merchandise counters demonstrating the universal application of the device according to the invention.

In a view corresponding to FIG. 9, FIG. 10 shows a merchandise counter of modified construction in which the carrier is formed by an extruded section 56. A constructional unit 70 of substantially identical construction may be mounted here in a suitable manner in a front zone at the underside 91 of the carrier. The rear zone 57 of this extruded section 56 is used for attaching this section 56 to a support 48 projecting up diagonally from the counter body. In the intermediate central zone 55, a light-directing shade 58 is integrated in the extruded section 56 in which the fluorescent tube mentioned above can be fastened as light source 27. The articulated part 20 employed in this case has a modified cross-sectional profile compared with FIG. 6, which provides for a flatter attitude of the sheet 10 in the lowered position compared with FIG. 9 and therefore results in a steeper raised position 10' of the sheet as indicated in dash-dot lines in FIG. 10. Also, in the present instance, the minimum overall width of the constructional unit 70 mentioned above has an advantageous effect in that the extruded section 56 need only have a small width 59.

Figure 11:
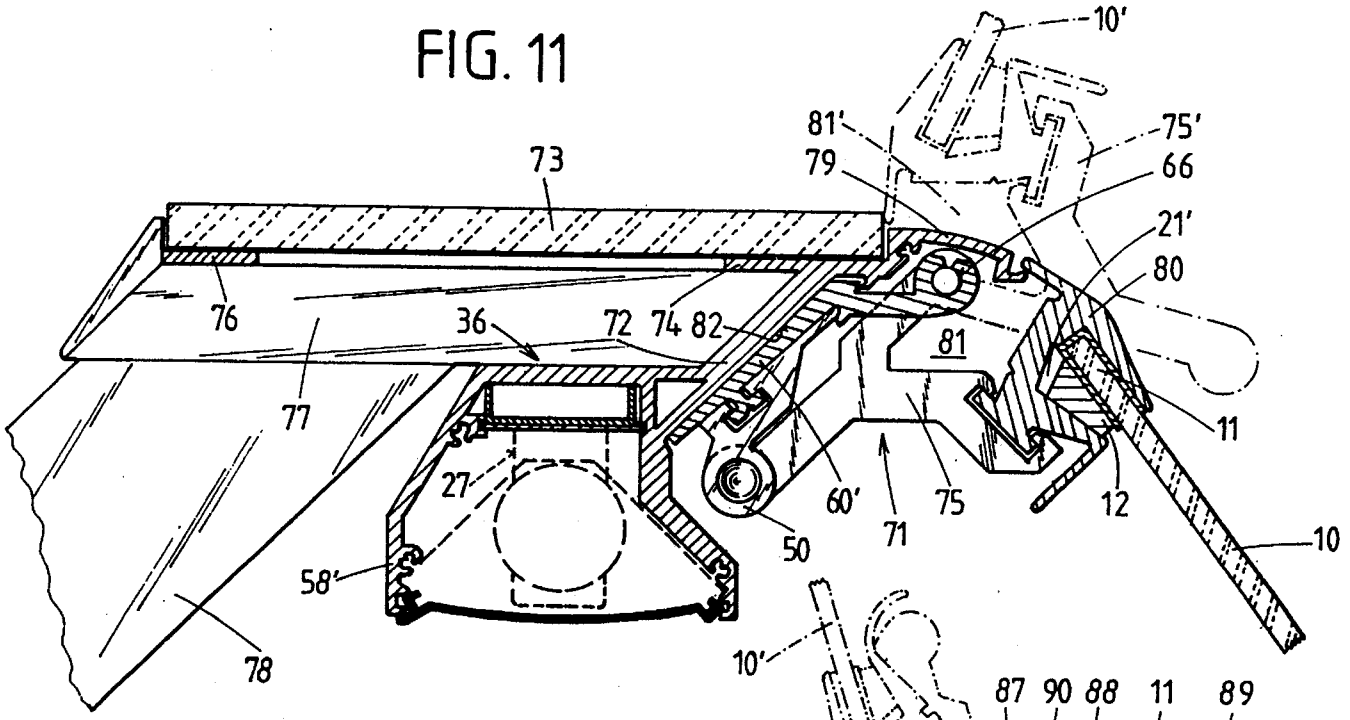

An extruded section also serves as a carrier in FIG. 11, where it has a formed on section piece in addition to the light-directing shade 58'. This carrier 36 serves to support an additional sales countertop 73 for the counter, for which purpose a section tab 74 facing toward the rear is provided on the section piece 72. Further, a front strip 79 facing in the opposite direction of the section tab 74 is provided at the section piece 72. This front strip 75 extends roughly at the same height as the upper surface of the sales countertop 73 and shields the lower region of the section piece 72 whose underside 81, in turn, serves for mounting a constructional unit 71 according to the invention. As shown by the shaded portion, this constructional unit 71 has a mounting base 60'. Bore holes 66 for an articulated part 75 of this constructional unit 71 similar to the second embodiment example in FIG. 7 are integrated in this mounting base 60' and determine the swivel axis. The mounting base 60' of this constructional unit 71 occupies an inclined position in the carrier 36. The rear region of the sales countertop 73 is supported at a flat rail 76 which is supported by a short horizontal arm 77 of a support 78 similar to the section tab 74 of the section piece 72 of the carrier 36. The support 78 extends diagonally from a counter body which is not shown in more detail. However, the location at which the constructional unit 71 is fastened to this carrier 36 in no way depends upon the position of the horizontal arms 77 and supports 78.

In the embodiment example shown in FIG. 11, the sheet 10 is not attached to an articulated part 75 directly, but rather indirectly via a continuous holding rail 80. This holding rail 80 engages the edge 11 of the sheet along its entire length. For this purpose, the holding rail 80 has the appropriate holding groove 21' in which this sheet edge 11 is clamped together with a holding strip 12. For the connection of the holding rail 80, the articulated part 75 has an undercut groove in which a rail head of the holding rail 80 engages and is secured by clamping screws or the like. The purpose of the holding rail 80 consists first in concealing the entire constructional unit 71 from an observer standing in front of it when the sheet is in its lowered position 10. The articulated part 75 has a three-armed cross section. The holding rail 80 sits on one of these arms, while another arm forms the swivel bearing with bore hole 66 of the mounting base 60'. Together with the holding rail 80, this second arm forms a cut out portion 81 whose function is illustrated in the swiveled out position 75' of the articulated part shown in dash-dot lines. In this position, the cut out portion arrives in position 81' and can enclose the aforementioned front strip 79 associated with the carrier 36.

Figure 12:
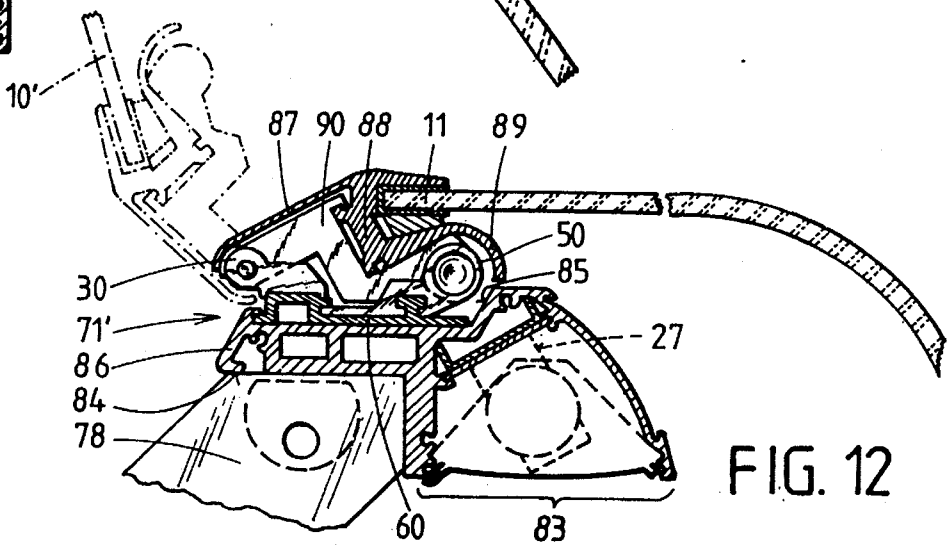

In the final embodiment example shown in FIG. 12, a curved front sheet 10 is used in a counter which need not have a sales countertop or the like. A constructional unit 71 of virtually the same construction can also be used in this case. This constructional unit 71 is outfitted with the corresponding mounting base 60 which has already been described more than once. In this case, as well, supports 78 project upward diagonally from the counter body. A particularly narrow extruded section serving as carrier 86 is fastened to the free end of the supports 78. Similarly as in FIG. 10, a light-directing shade 83 is integrated in the carrier 86 for arranging light sources 27. The horizontal arms 77 mentioned in the preceding embodiment example can be omitted here. The supports 78 act on the underside 84 of the carrier 86, the light-directing shade 83 also opening downward.

The distinctive feature of the embodiment example shown in FIG. 12 consists in that the upper side 85 of the carrier 86 serves for fastening the constructional unit 71. Therefore, in contrast to the construction shown in FIGS. 2 and 3, the support parts 50 are now situated at the front side, while the bearing parts 30 of the constructional unit 71' face to the rear. In so doing, it is sufficient to employ an articulated part 90 having a suitably adapted cross-sectional profile since, in other respects, all other structural component parts of the constructional unit 70 shown in FIG. 3 may also be used for this constructional unit 71'. In the present case, the articulated part 90 has a Z-shaped cross-sectional profile. In this instance, the sheet 10 is also connected with the articulated part 90 indirectly via a holding rail 88. Also, this holding rail 88 is connected with the articulated part 90 via a correspondingly adapted engagement section and engages the sheet edge 11 along its entire length. The holding rail 88 has two section legs 87, 89 which, in the lowered position 10 of the sheet indicated by a solid line in FIG. 12, overlap the strips on the upper side 85 of the carrier which serve for arranging the constructional unit 71. However, the constructional unit 71' is easily accessible when the sheet is transferred to its raised position 10' illustrated by dash-dot lines in FIG. 12.

In a modification of the constructions shown in FIGS. 10 and 11, the described guide 61 or guides 61, 62 for the bearing parts 30 and supporting parts 50, respectively, could be formed on directly at the underside 61 and 82 of the extruded section 56 shown in FIG. 10 or the section piece 72 in FIG. 11, respectively, rather than at the mounting base 60 and 60'. Accordingly, these guides could be mounted on the underside 85 of the carrier in the construction shown in FIG. 12. In this modified construction, the structural component parts are mounted directly on the carriers 56, 36, 86 instead of being preassembled to form the described constructional units 70, 71, 71'.

The device according to the invention and the constructional units produced along with it could also be mounted on enclosures other than counters, e.g., on cover housings for electric control units. Tailgates in vehicles could also be outfitted with the device according to the invention.

While the foregoing description and drawings represent the preferred embodiments of the present invention, it will be obvious to those skilled in the art that various changes and modifications may be made therein without departing from the true spirit and scope of the present invention.

What is claimed is:

1. In a device for swiveling a sheet, in particular in refrigeration counters and/or merchandise counters, having a stationary bearing part for supporting an articulated part which supports the sheet and allows the sheet to swivel about a substantially horizontal axis between a lowered position and a raised position in a substantially vertical swiveling plane, and having an energy accumulator serving as auxiliary lifting means for lifting the sheet, wherein the energy accumulator has two connection ends which are loaded so as to move away from one another and which determine an effective direction of force of the energy accumulator, one connection end being articulated at the articulated part so as to participate in its movement, while the other connection end is articulated in a stationary manner, wherein the energy accumulator is arranged with its effective direction of force substantially transverse to the swiveling plane of the sheet; and the two connection ends of the energy accumulator are constructed as three-dimensionally acting joints each with three rotational degrees of freedom.

2. The device according to claim 1, wherein said substantially horizontal axis is a swivel axis and wherein the effective direction of force of the energy accumulator extends substantially parallel to the swivel axis in the lowered position of the sheet and at an angle to the swivel axis in the raised position.

3. The device according to claim 1, wherein one of said connection ends is an inner connection end of the energy accumulator which participates in movement acts on a lateral surface of the articulated part facing in a direction of the swivel axis.

4. The device according to claim 3, wherein the lateral surface of the articulated part forms a spherical socket of a ball joint, while a spherical head is arranged at the connection end of the energy accumulator.

5. The device according to claim 1, wherein a common articulated part is arranged between two energy accumulators and inner connection ends of the two energy accumulators act on opposite lateral surfaces of the articulated part.

6. The device according to claim 5, wherein the two energy accumulators are arranged in a mirror-inverted manner relative to one another and exert a substantially identical force load.

7. The device according to claim 1, wherein the articulated part is formed by a profiled part with a rectangular profile, where opposite sides of the profiled part are acted upon by two bearing pans via aligned bearing pins as well as by at least one energy accumulator, specifically in end regions of these sides.

8. The device according to claim 1, wherein the articulated pan and its two bearing parts determining the swivel axis, and at least one support part providing stationary articulation of the energy accumulator are arranged jointly on a mounting base and this mounting base, together with the energy accumulator mounted between the articulated pan and the support part, form a constructional unit which is fastened to a substantially horizontally extending carrier.

9. The device according to claim 8, wherein the mounting base is formed by a portion cut out from a section bar.

10. The device according to claim 8, wherein the mounting base has at least one guide which extends substantially parallel to the swivel axis and serves for adjustable mounting of the support part for the energy accumulator and/or the bearing parts for the articulated part.

11. The device according to claim 10, wherein the guide is formed by a longitudinal rail which is formed on and which is integral with the mounting base.

12. The device according to claim 10, wherein the support part is mounted on its guide and engages behind a profile strip with its bracket arm, which profile strip can be a component part of the guide for the bearing parts.

13. The device according to claim 10, wherein the mounting base has an angular section with two legs, one leg serves for fastening the constructional unit and for mounting the support part, while the other leg has a continuous bore hole and is partially cut out, wherein this cut out portion receives the articulated part via two pins which engage in the bore holes of the two adjoining leg parts, these two leg parts directly forming the bearing parts for the articulated part.

14. The device according to claim 8, wherein the carrier serving for the attachment of the constructional unit extends parallel to the swivel axis of the sheet and an underside of the carrier supports longitudinally extending light-directing shades in which illumination means are arranged.

15. The device according to claim 14, wherein the constructional unit is fastened at the underside of the carrier parallel to the light-directing shades and an upper side of the carrier serves as a so-called sales countertop of a merchandise counter.

16. The device according to claim 15, characterized in that the carrier is formed by an extruded section in which the light-directing shade is integrated.

17. The device according to claim 15, wherein the light-directing shade has a section piece which is formed on integrally therewith and serves for fastening the constructional unit to the carrier.

18. The device according to claim 14, wherein the constructional unit is fastened to the upper side of the carrier, while the light-directing shade is mounted at the underside of the carrier.

19. The device according to claim 14, wherein guides for the at least one support part and/or bearing parts and, where appropriate, longitudinally extending bore holes for receiving bearing pins for the articulated part are integrated directly at the carrier or section piece of the light-directing shades.

20. The device according to claim 1, wherein the articulated part has a holding groove extending parallel to its swivel axis for receiving an edge region of the sheet.

21. The device according to claim 20, wherein the holding groove has a holding profile which tapers in a wedge-shaped manner and receives the edge region of the sheet and at least one holding strip with a wedge-shaped cross section, wherein a sequence of arrangement of the sheet and holding strip in the holding groove can be reversed.

* * * * *